United States Patent [19]

Muraguchi

[11] Patent Number: 5,005,244

[45] Date of Patent: Apr. 9, 1991

[54] DEVICE FOR CLEANING CYLINDRICAL OBJECTS, SUCH AS BOLTS

[75] Inventor: Yutaka Muraguchi, Fukuoka, Japan

[73] Assignee: Hoko Sangyo Co., Ltd., Fukuoka, Japan

[21] Appl. No.: 423,471

[22] PCT Filed: Jan. 30, 1989

[86] PCT No.: PCT/JP89/00090

§ 371 Date: Sep. 25, 1989

§ 102(e) Date: Sep. 25, 1989

[87] PCT Pub. No.: WO89/07019

PCT Pub. Date: Aug. 10, 1989

[30] Foreign Application Priority Data

Feb. 5, 1988 [JP] Japan ..... 63-26206
Sep. 6, 1988 [JP] Japan ..... 63-224155

[51] Int. Cl.[5] ..... A46B 13/02; B08B 9/02

[52] U.S. Cl. ..... 15/88; 15/22.1; 15/104.04

[58] Field of Search ..... 15/21 R, 56, 67, 88, 15/104.04, 22 R

[56] References Cited

U.S. PATENT DOCUMENTS

| | | | |
|---|---|---|---|
| 4,011,617 | 3/1977 | Toelke et al. | 15/88 |
| 4,372,003 | 2/1983 | Toelke | 15/88 |
| 4,403,363 | 9/1983 | Hess | 15/88 |
| 4,433,448 | 2/1984 | True | 15/88 |
| 4,467,489 | 8/1984 | Begneaud | 15/88 |

*Primary Examiner*—Edward L. Roberts
*Attorney, Agent, or Firm*—Jordan and Hamburg

[57] ABSTRACT

A device for cleaning cylindrical objects such as bolts has a sleeve (1) which contains a rotor (2) equipped with a brush (7). A bolt is inserted into the sleeve (1), and the rotor (2) is rotated by a motor (4) to clean the periphery of the bolt. The sleeve (1) is connected to a suction means of negative pressure such as blower (11), and the motor (4) is capable of rotating the rotor (2) in one or the other direction. In the cleaning device a bolt is enclosed in the sleeve (1) and is cleaned with the brush (7) which is driven in contact with the peripheral surface of the bolt by the rotation of the rotor (2). Dust and dirt generated by the cleaning are prevented from leaking out of the sleeve and collected in the suction means of negative pressure. As the rotor (2) rotates in one or the other direction by the motor (4), furthermore, the rotating direction of the brush (7) is set to meet the direction in which the lead of the thread of the bolt advances.

6 Claims, 2 Drawing Sheets

DEVICE FOR CLEANING CYLINDRICAL OBJECTS, SUCH AS BOLTS

FIELD OF ART

This invention relates to a device for cleaning cylindrical objects, such as bolts, shafts and pins.

BACKGROUND OF THE INVENTION

Various kinds of bolts and nuts are used for fastening together various parts of a machine, whether it may be a common industrial machine or a machine designed for a specific purpose. When the bolts and nuts are removed to enable the inspection or replacement of any machine part, it is also usual to clean the screw threads of the bolts. The simplest method of cleaning any such bolt is to apply a wire brush or the like to its surface to remove stain or foreign matter therefrom. This kind of work has been done manually. There is also known a device which has been developed exclusively for cleaning a specific type of bolts efficiently.

Boilers, reactors, steam turbines and related equipments in steam or nuclear power plants are periodically inspected, either in accordance with law or voluntarily. The inspection includes not only the disassembling of the machine parts, but also the strict examination of the bolts and nuts. It is, for example, necessary to clean the bolts by removing any foreing matter from their screw threads and polishing them.

There is, however, a limit to the efficiency which can be achieved if the bolts are cleaned manually by means of an ordinary or rotary brush, or the like. The scattering of dust is unavoidable, even if a special cleaning device may be employed. It is necessary to keep any dust from rising, particularly in a nuclear power plant, since it is likely to result in a greater danger of radioactive contamination. Therefore, it is usual to, for example, set up a tent enclosing the place where any such cleaning work is done, and collect any rising dust into a disposal system by a blower. The cleaning work which makes it necessary to set up a tent whenever it is done is, however, far from efficient.

The bolts to be cleaned are removed from the machine parts and carried to the tent. If the bolts to be cleaned are of the type which cannot be brought to the tent, such as bolts embedded in a turbine casing, it is necessary to set up another tent enclosing the place where they exist. Even if a special cleaning device may be available, it is necessary to do any such cleaning work in a tent at the sacrifice of efficiency, as the device has no sealing mechanism that can prevent the scattering of dust.

The present applicant has filed Japanese Patent Application No. 238011/1987 which discloses a device designed for the efficient cleaning of bolts, etc. This device includes a sleeve in which the bolt to be cleaned is placed, and a rotor disposed therein and having a brush. The bolt is held by the rotor and is polished by the brush disposed on the peripheral surface of the rotor.

An arm is pivotally attached to the peripheral surface of the rotor. A centrifugal force acts on the arm when the rotor is rotated, and brings the brush into rubbing contact with the surface of the bolt. The arm forms the free end of the rotor and is, therefore, vibrated considerably when the rotor is rotated at a high speed. The arm forms a center of mass and is, therefore, likely to cause resonance, depending on its length and the rotating speed of the rotor. Its resonance results in a heavy vibration of the entire device. The vibration of the device not only imposes a great burden on a man holding it during a particular cleaning job, but also causes the generation of a large noise and is even likely to result in its own destruction.

If the cleaning device is rotated only in such a direction that the brush is moved in the direction opposite to the lead of a screw thread, the thread not only imparts a greater resistance to the operation of the device, but also causes it to vibrate to a greater extent. Therefore, in case that the brush is continuously contacted to the periphery of the bolt throughout the operation, if the direction of rotation of the brush differs from the lead of the screw thread, the resistance imposes a greater burden on the worker and gives him a greater amount of fatigue, while the vibration is undesirably transmitted to his hands. The continuance work of such operation will not be good for the health of the worker. A still greater burden is imposed on the worker who has to use a larger device for cleaning a larger bolt. When cleaning, for example, an upright embedded bolt, he has to move the device up and down. No efficiency can be expected from any work when he has to support the weight of the device manually.

If the brush is rotatable only in one direction, it always takes the same position when contacting the screw thread and can, therefore, clean only one flank thereof, while leaving the other flank thereof uncleaned.

SUMMARY OF THE INVENTION

It is, therefore, an object of this invention to provide a device which can clean a cylindrical object, such as a bolt, efficiently and is easy to use without vibrating. It is another object of this invention to provide a device which can be held lightly by hand for cleaning a bolt easily and effectively, as its operation can be performed along the screw thread on the bolt.

In order to accomplish the above objects, the cleaning device according to the present invention is characterized in that a device for cleaning a cylindrical object such as bolts comprises a sleeve having an open end, a rotor provided in the sleeve substantially coaxially therewith, the object being placed in the sleeve, a driving device provided on the sleeve for driving the rotor in one or the other direction, a plurality of arms each having a base end supported on the rotor and provided with a brush at its free end, the arms being connected to the outer periphery of the rotor by means of pins and being swingable toward the radial direction, a holding ring provided around the rotor movably in the axial direction of the rotor and having a tapered wall portion in the outer periphery thereof against which the proximal ends of the arms detachably engage, and an exhaust circuit connected to the sleeve, the exhaust circuit comprising a means of suction due to negative pressure and being able to exhaust the air together with dust in the sleeve.

The brushes provided on the arms are brought into rubbing contact with the surface of the bolt by rotating the rotor in which the bolt is inserted. The cleaning operation is performed in the sleeve which forms a enclosed space to the exterior. Further, since one end of each arm is held by the holding ring, the arms do not strongly swing when the rotor rotates at a high speed, which leads to restraint of vibration and noise.

When the driving device drives the rotor to rotate in one or the other direction, the brush moves by the lead of the screw of the bolt, and the brush is mechanically inserted and pulled out using the lead of the screw.

DESCRIPTION OF THE PREFERRED EMBODIMENTS

An embodiment of this invention is explained hereinafter with the reference to the embodiments shown in Figures.

Figure 1:
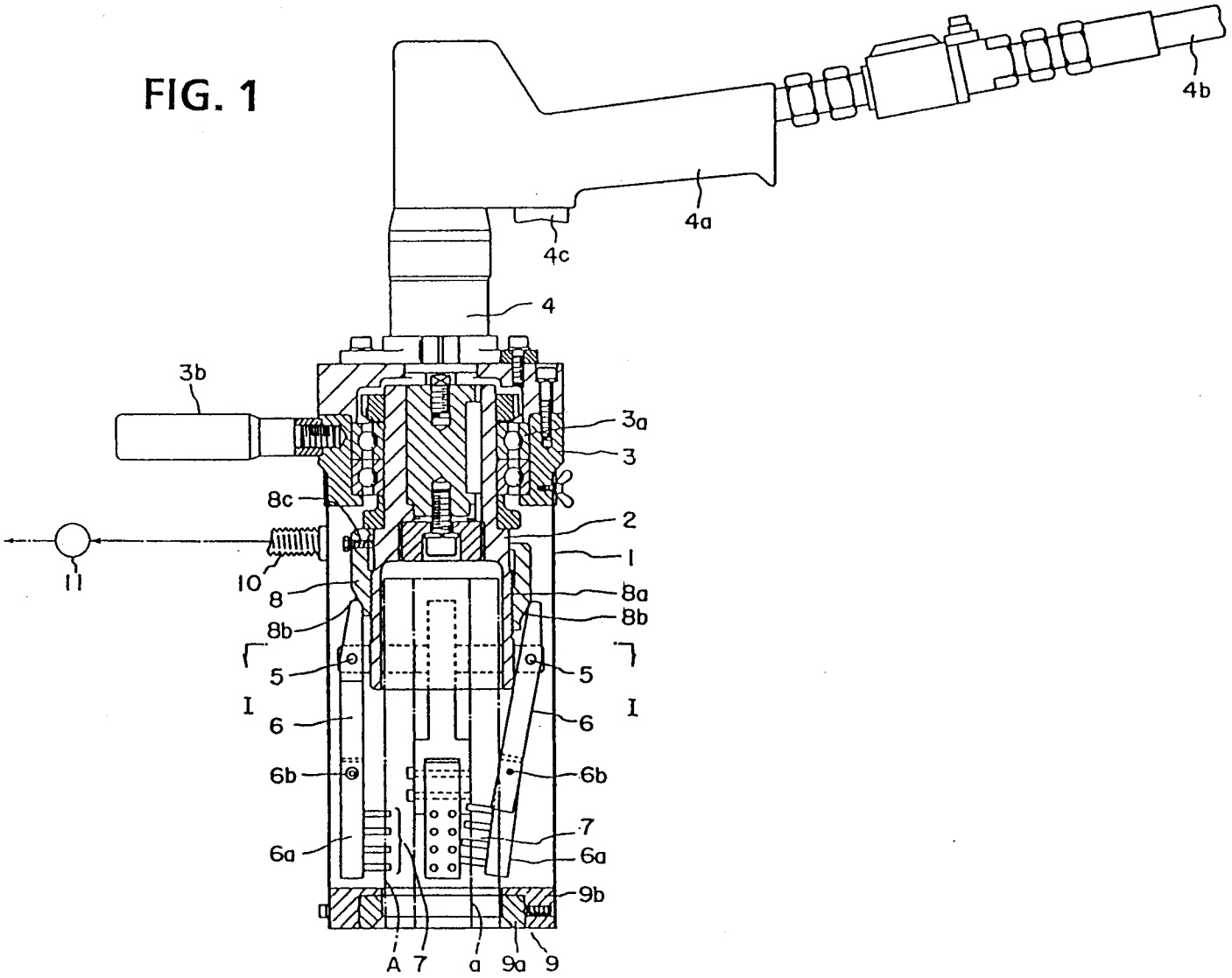
FIG. 1 is a side elevational view indicating operation of the cleaning device embodying this invention.
Figure 2:
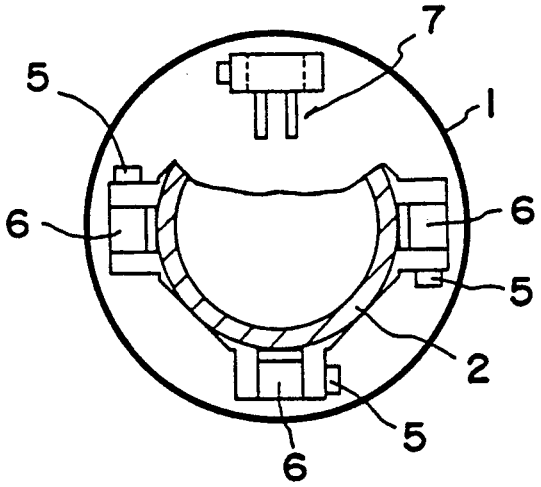
FIG. 2 is a sectional view taken along the line I—I of FIG. 1.

FIG. 1 is a side elevational view indicating operation of the cleaning device shown in an example of this invention, and FIG. 2 is a sectional view taken along the line I—I of FIG. 1. This embodiment shows a device for cleaning each of a plurality of bolts (A) embedded in a turbine casing.

The bolts (A) are fixed in an equally spaced apart relation from one another. The device is adapted to enclose the entire bolt (A) to be cleaned, and clean and polish its surface.

The device includes a circular cylindrical sleeve 1 and a rotor 2 disposed in the sleeve 1 coaxially therewith. A base block 3 is connected to the upper end of the sleeve 1. Bearings 3*a* are provided in the base block 3 for supporting the rotor 2 rotatably. A pneumatic motor 4 is mounted on the base block 3 for rotating the rotor 2. The motor 4 has an output shaft which is rotatable at a high speed in either direction when it is supplied with compressed air. The motor 4 has a projecting portion defining a handle 4*a* to which a hose 4*b* is connected for supplying compressed air to the motor 4. The handle 4*a* is also provided with a switch 4*c* which is used for starting the rotation of the motor 4 in either direction or stopping it. A grip bar 3*b* is attached to the base block 3. The user of the device can grip it for transporting or adjusting its position relative to the bolt (A) to be cleaned.

The rotor 2 rotated by the motor 4 is a hollow cylinder having an open lower end. Four cleaning mechanisms are connected to the outer peripheral surface of the rotor 2.

Each cleaning mechanism comprises an arm 6 connected to the outer surface of the rotor 2 rotatably by a pin 5 and carries at its lower end a brush 7 which is formed by a multiplicity of filaments of steel wire. The pin 5 lies horizontally and at right angles to the radius of the rotor 2, as shown in FIG. 2, so that the arm 6 may be rotatable in a vertical plane to or away from the longitudinal axis of the rotor 2.

Each arm 6 has a lower end to which an auxiliary arm 6*a* is rotatably connected by a pin 6*b*, so that the position of the brush 7 can be adjusted to suit the outside diameter of the bolt (A) to be cleaned. The brush 7 can, therefore, be placed in uniform contact with even a bolt having a considerably small diameter. If the auxiliary arm 6*a* is, however, connected to the arm 6 in a fixed way instead of being rotatable by the pin 6*b*, the brush 7 can be pressed against the surface of the bolt (A) more strongly.

A holding ring 8 is provided around the rotor 2 for engaging the upper ends of the arms 6 and thereby holding them against movement. The holding ring 8 is connected around the rotor 2 threadedly as shown at 8*a*, and is movable along the axis of the rotor 2 if it is turned. The ring 8 has toward its lower end a tapered wall portion 8*b* having a gradually decreasing outside diameter. The tapered wall portion 8*b* has an outer surface engaging the inner edge of the upper end of each arm 6. If the ring 8 is moved along the rotor 2, therefore, its tapered wall portion 8*b* causes the arms 6 to rotate around the pins 5 and thereby alter their positions. The ring 8 can be secured to the rotor 2 by a lock bolt 8*c* extending through its wall near its upper end.

A ring 9 is fitted in the lower end of the sleeve 1 for maintaining the bolt (A) in axial alignment with the sleeve 1 and also defining a substantially closed space in the sleeve 1. The ring 9 has an inside diameter which is substantially equal to the outside diameter of the bolt (A) to be cleaned. The ring 9 consists of an inner annular portion 9*a* made of a hard synthetic resin and engaging the bolt (A), and an outer annular portion 9*b* made of a metal or preferably a synthetic resin and supporting the inner portion 9*a*. This construction ensures that the ring 9 causes no harm to the screw thread on the bolt (A). The ring 9 enables the coaxial positioning of the sleeve 1 with the bolt (A) and facilitates the insertion of the bolt (A) into the rotor 2. It also enables the smooth operation of the device which is free from any chattering or any interference between the inner surface of the rotor 2 and the outer surface of the bolt (A). The inner portion 9*a* of the ring 9 has an inside diameter which is slightly larger than the outside diameter of the bolt (A). A flexible hose 10 is connected to the sleeve 1 for collecting any dust that rises therein when the bolt (A) is cleaned. A suction blower 11 is connected to the hose 10.

Referring now to the operation of the device as hereinabove described, the device is so positioned that the bolt (A) to be cleaned may be inserted therein through the ring 9 at its lower end. The ring 9 enables the axial alignment of the sleeve 1 with the bolt (A) and thereby facilitates the insertion of the bolt (A) into the rotor 2.

FIG. 1 shows the bolt (A) and also another bolt (a) having a smaller diameter for the mere sake of explanation. The two arms 6 appearing in FIG. 1 are shown in different positions from each other for the mere sake of explanation. The left arm 6 is in its position suited for cleaning the bolt (A), and the right arm 6 in its position for cleaning the bolt (a). The position of each arm 6 depends on the diameter of the bolt (A) or (a) to be cleaned and is altered by the positional adjustment with use of the holding ring 8. FIG. 1 shows two halves of the ring 8 in different positions from each other for the mere sake of explanation. The left half of the ring 8 is shown in its raised position in which the upper end of the arm 6 engages the tapered wall portion 8*b* of the ring 8 adjacent to its lower end, so that the arm 6 may stay in its upright position enabling the brush 7 to contact the surface of the bolt (A) effectively. On the other hand, the right half of the ring 8 is shown in its lowered position in which the upper end of the arm 6 engages the tapered wall portion 8*b* of the ring 8 at its upper end, so that the arm 6 may have its lower end positioned closer to the longitudinal axis of the sleeve 1 enabling the brush 7 to contact the bolt (a) having a smaller diameter effectively.

If compressed air is supplied to the motor 4 to rotate its output shaft, the rotor 2 is rotated to cause the brushes 7 to rotate about the bolt (A) or (a) in rubbing contact with its surface, whereby foreign matter is removed from the bolt (A) or (a) and its surface is polished. It is possible to clean the whole bolt (A) if the bar 3*b* and the handle 4*a* are gripped to raise the device gradually. The rotor 2 is rotated at a speed of 600 to 1300 rpm.

The dust which rises when the bolt is cleaned is drawn by the blower 11 and collected through the hose 10 into an appropriate dust collector not shown. The inner portion 9*a* of the ring 9 has an inside diameter which is slightly larger than the diameter of the bolt (A), as hereinbefore stated. Therefore, the bolt (A) and the ring 9 have therebetween a small clearance through which air can flow into the sleeve 1, when the dust is drawn by the blower 11. No dust flows out through the clearance, since the clearance is small and the air in the sleeve 1 is drawn into the hose 10. The device can finish any cleaning job without causing any leakage of dust and thereby maintain a good working environment. Therefore, the device can overcome, for example, any problem of radioactive contamination that has hitherto been likely to occur during the maintenance and inspection of facilities in a nuclear power station.

The arms 6 are held by the holding ring 8 in their positions suited for the diameter of the bolt (A) or (a) to be cleaned. When the rotor 2 is rotated, the lower end of each arm 6 is radially outwardly moved by a centrifugal force, as it has a greater mass than that of the upper end portion thereof which is rotatably supported by the pin 5. On the other hand, the upper end of each arm 6 is moved radially inwardly and abuts on the tapered wall portion 8*b* of the holding ring 8, whereby the arm 6 is held in a particular position. Therefore, it is possible to maintain the brushes 7 in appropriate rubbing contact with the surface of the bolt (A) or (a) to be cleaned, if the holding ring 8 is appropriately positioned.

Figure 3:
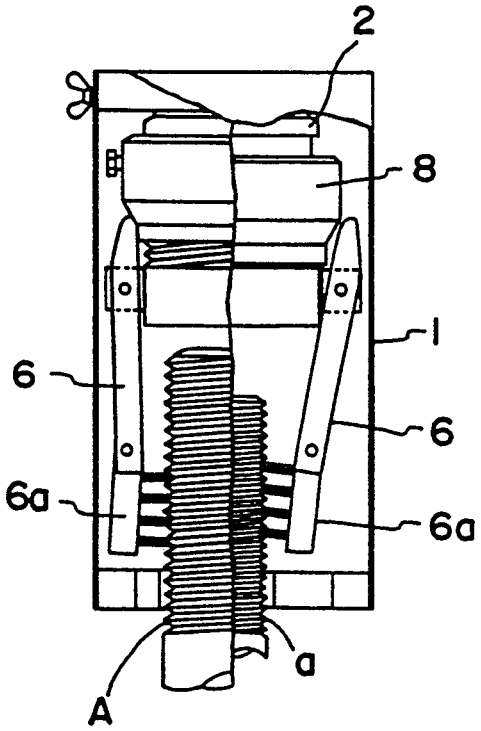
FIG. 3 is a fragmentary longitudinal sectional view of the cleaning device for cylindrical objects including bolts which are respectively different in diameter.

The bolts (A) and (a) are shown more clearly with two brushes 7 in FIG. 3. As is obvious therefrom, each brush 7 engages in the groove defined by the screw thread on the bolt (A) or (a) when it is in its appropriate cleaning position. Therefore, each brush 7 can be moved along the screw thread and groove in intimate contact therewith with the rotation of the rotor 2 if it is made of a relatively hard material, such as steel filaments. In other words, each brush 7 is movable up or down, depending on the direction of rotation of the rotor 2, by turning about the bolt (A) or (a), as if it were a nut. If the switch 4*c* is used to rotate the output shaft of the motor 4 in one or the other direction, it is possible to move the cleaning device up or down, while the bolt (A) or (a) stays at a standstill.

The screw thread or groove on the bolt (A) or (a) can, thus, be utilized to cause the cleaning device to move up or down automatically by turning about the bolt (A) or (a). Therefore, the user of the device can clean the bolt (A) or (a) along its whole length simply by holding the handle 4*a* lightly, positioning the device appropriately relative to the bolt, and turning on the switch 4*c*. The brushes 7 move along the screw thread to clean the bolt (A) or (a) from its upper to its lower end if the rotor 2 is rotated in one direction, and clean it from its lower to its upper end if the rotation of the rotor 2 is reversed. The user does not need to hold the device strongly, but is only required to use a greatly reduced force for doing any cleaning job.

Even if the device may vibrate heavily, its vibration does not exert any adverse effect on the user or cause any hazard to him, insofar as he has only to hold the device lightly.

As the arms 6 are held in position by the ring 8, the device does not make any appreciable vibration even when the rotor 2 is rotated at a high speed, as opposed to the conventional cleaning device which relies solely upon the centrifugal force. Although the arms 6 are rotatably supported on the rotor 2 by the pins 5, the arms 6 are held by the ring 8 at their upper ends throughout any particular cleaning job as if they were integral parts of the rotor 2, and do not make any appreciable vibration or noise.

Although the device has been described as being used for cleaning the bolt (A) or (a) embedded in a turbine casing, the device of this invention is, of course, useful for cleaning any independent bolt, if a jig or the like is used for holding the bolt in a vertical or horizontal position.

The device of this invention can also be used for cleaning any other cylindrical machine elements, such as a pin or shaft. Although the brushes 7 have been described as being made of steel filaments, they can also be formed from any other materials, such as filaments of stainless steel, brass or nylon, if they are suitable for the object to be cleaned.

The brushes 7 can be made of other materials which are sufficiently hard or rigid to enable the cleaning device as a whole to move along the screw thread on the bolt (A) or (a).

Moreover, mechanization can be promoted if a plurality of bolts (A) or (a) to be cleaned are to be disposed beforehand and cleaning device is so designed as to be movable on rails or by any other appropriate means in the direction of the disposed bolts. A still higher degree of efficiency can be expected from such continuous cleaning if a control system is provided for enabling the cleaning device to stop automatically in front of each object to be cleaned.

INDUSTRIAL FEASIBILITY

In the cleaning device according to this invention, a rotor which encloses a cylindrical body in a sleeve enclosing the cylindrical body with space around is disposed, and the brushes are brought into rubbing contact with the surface of the bolt when the rotor is rotated. The operation is easier and more efficient than any conventional manual cleaning. The device also enables the uniform cleaning of all the bolts used for fastening together the parts of a particular machine, and ensures the cleaning work which satisfies the requirements of inspection and maintenance imposed on the machine. The sleeve enclosing the object to be cleaned keeps any dust from scattering and thereby enables the maintenance of a good working environment. The holding ring prevents the arms from being displaced by a centrifugal force, or vibrating, even when the rotor is rotated at a high speed. Therefore, the device is easy to use without making any undesirable vibration or noise, and is free from any fear of being broken as a result of the occurrence of resonance.

The brushes can be moved spirally around the bolt along its screw thread, as if they were nuts. If the rotor is rotated in either direction, the cleaning device can be moved in either direction along the axis of the bolt. Therefore, the device can perform the cleaning of any bolt while moving along its screw thread, only if the user thereof holds the device lightly in its position suited for the bolt. The load to be imposed on the user of the device can be reduced. As it is sufficient for the user to hold the device lightly, he is free from any danger of a hazard due to its vibration. The device can, therefore, be used for a wide range of applications.

I claim:

1. A device for cleaning a cylindrical object comprising:

a sleeve having an open end;

a rotor means rotatably mounted in said sleeve for rotation about a rotary axis, said rotor means being coaxial with said sleeve, said object being placed in said sleeve;

drive means on said sleeve for rotatably driving said rotor means;

a plurality of arms each having end portions and an intermediate portion intermediate said end portions, a brush on one of said end portions and a first engageable surface on the other of said end portions;

pivot means on said intermediate portion pivotably mounting each of said arms on said rotor for pivotal movement about an axis generally perpendicular to said rotary axis; and adjustable holding means on said rotor means having a second engageable surface engaging said first engageable surfaces of said arms to limit the pivotal movement of said arms in one pivotal direction to a limited pivotal position which determines the largest distance of each brush from said rotary axis, said adjustable holding means being adjustably mounted on said rotor means for adjustable axial movement such that different adjusted positions of said adjustable holding means varies said limited pivotal position of said arms, whereby said adjustable holding means is thereby operable to vary the largest distance of each brush from said rotary axis so that varying diameter objects are cleanable by said brushes.

2. A device according to claim 1, wherein one of said first and second engageable surfaces is disposed at an acute angle relative to said rotary axis.

3. A device according to claim 1, wherein said second engageable surface is a frustro-conical surface on said adjustable holding means.

4. A device according to claim 1, wherein adjustable holding means comprises a holding ring and thread means on said rotor means engaged by thread means on said holding ring.

5. A device according to claim 1, further comprising exhaust means connected to said sleeve for applying a negative pressure to said sleeve for exhausting air and dirt from said sleeve.

6. A device according to claim 1, wherein said second engageable surface of said adjustable holding means is simultaneously engageable with all of the first engageable surfaces of all of said arms such that adjustable axial movement of said adjustable holding means simultaneously varies the limited pivotal position of all of said plurality of arms.

* * * * *